United States Patent [19]

Weigand et al.

[11] 4,340,782

[45] Jul. 20, 1982

[54] CIRCUIT FOR DEMODULATING AMPLITUDE AND ANGLE MODULATED BROADCAST SIGNALS

[75] Inventors: James R. Weigand; Robert D. Streeter, both of Fort Wayne, Ind.

[73] Assignee: Magnavox Consumer Electronics Co., Fort Wayne, Ind.

[21] Appl. No.: 159,357

[22] Filed: Jun. 13, 1980

[51] Int. Cl.[3] ..... H04H 5/00

[52] U.S. Cl. ..... 179/1 GS; 329/135; 455/212

[58] Field of Search ..... 179/1 GS, 1 GD; 329/135, 130, 147, 167; 455/212, 222, 223, 296

[56] References Cited

U.S. PATENT DOCUMENTS 3,457,512 7/1969 Deman ..... 455/212
4,144,500 3/1979 Tokunaga ..... 455/212
4,159,396 6/1979 Hilbert et al. ..... 179/1 GS
4,195,203 3/1980 Sakai et al. ..... 179/1 GD

FOREIGN PATENT DOCUMENTS 54-156410 12/1979 Japan ..... 455/212

*Primary Examiner*—Douglas W. Olms
*Attorney, Agent, or Firm*—George R. Pettit

[57] ABSTRACT

A superheterodyne receiver is described for demodulating signals containing both amplitude and angle modulation components. An intermediate frequency signal is produced which is simultaneously amplitude detected as well as angle demodulated. Detector means are provided for detecting the occurrence of high negative amplitude modulation peaks of the broadcast signal. During high negative amplitude modulation peaks, the angle demodulator output is held at a fixed level until the amplitude of an input signal is restored to a predetermined minimum level.

10 Claims, 3 Drawing Figures

CIRCUIT FOR DEMODULATING AMPLITUDE AND ANGLE MODULATED BROADCAST SIGNALS

BACKGROUND OF THE INVENTION

The present invention relates to receivers for demodulating broadcast signals having both amplitude and angle modulation components. Specifically, an apparatus is provided to minimize the distortion resulting from angle demodulating broadcast signals having marginal amplitude levels.

Recent interest has developed in generating stereophonic broadcast signals in the low frequency radio spectrum now reserved for amplitude modulation. Several proposals have been submitted to the FCC which suggest a new stereophonic broadcast service in that portion of the broadcast radio spectrum which utilizes amplitude modulation. The Magnavox Consumer Electronics Company has proposed a system for generating a broadcast signal which is amplitude modulated with the summation of two stereophonic related signals and linearly phase modulated with a difference signal produced by subtracting the stereophonic related signals. Specifics for this and other proposals for stereophonic broadcasting are to be found in FCC Docket 21313, "In The Matter of AM Stereophonic Broadcasting".

Difficulty in receiving and demodulating broadcast signals having both amplitude and angle modulation components is encountered during periods of high negative amplitude modulation of the broadcast signal. The angle demodulation process suffers from a loss of signal as the instantaneous amplitude level of the broadcast signal approaches zero. Under these conditions, conventional limiters and angle demodulators produced noise when demodulating a signal having a marginal amplitude. Therefore, the reception of such stereophonic broadcasts suffers during those periods of time that the negative amplitude modulation approaches 100% corresponding to a zero carrier level.

SUMMARY OF INVENTION

It is an object of this invention to minimize the affects of amplitude modulation on apparatus for angle demodulating signals.

It is a more particular object of this invention to provide stereophonic related signals from an amplitude and angle modulated broadcast signal under high negative amplitude modulation conditions.

These and other objects are accomplished by apparatus in accordance with the invention. A receiver is provided for demodulating a broadcast signal having both amplitude and angle modulation. Conversion means are provided to derive an intermediate frequency signal having the amplitude and angle modulation components of interest. An angle demodulator is provided whereby variations in the phase or frequency of the broadcast signal may be detected. During periods when high negative amplitude modulations are present, a sample and hold means maintains an angle demodulated signal at a constant amplitude which avoids objectionable noise produced when a signal having a marginal or zero amplitude is being demodulated. When the amplitude of the angle modulated signal is restored to a level at which successful angle demodulation is possible, the sample and hold means enters a continuous path mode and the angle demodulation signal is further processed.

In a preferred embodiment of the invention, a receiver is provided for demodulating a broadcast signal which is amplitude modulated with the summation of stereophonic related signals, and linearly phase modulated with the difference of the stereophonic related signals. An intermediate frequency signal is produced having both the desired amplitude and linear phase modulation components. A limiter is employed to limit the amplitude excursions of the intermediate frequency signal which is thereafter phase detected. A standard amplitude modulation detector is provided for providing a signal proportional to the summation of the stereophonic related signals. The output of the amplitude detector and phase detector are summed in a matrix means to provide first and second stereophonically related signals. During periods when the amplitude modulation reaches a high negative peak level, the phase detector output signal is maintained at a fixed level until the intermediate frequency signal amplitude is restored to an adequate level. Thus, signals having a marginal amplitude are not angularly demodulated thereby avoiding noise which occurs when a limiter can no longer supply a information signal having an adequate amplitude for phase detection.

DESCRIPTION OF THE PREFERRED EMBODIMENT

Figure 1:
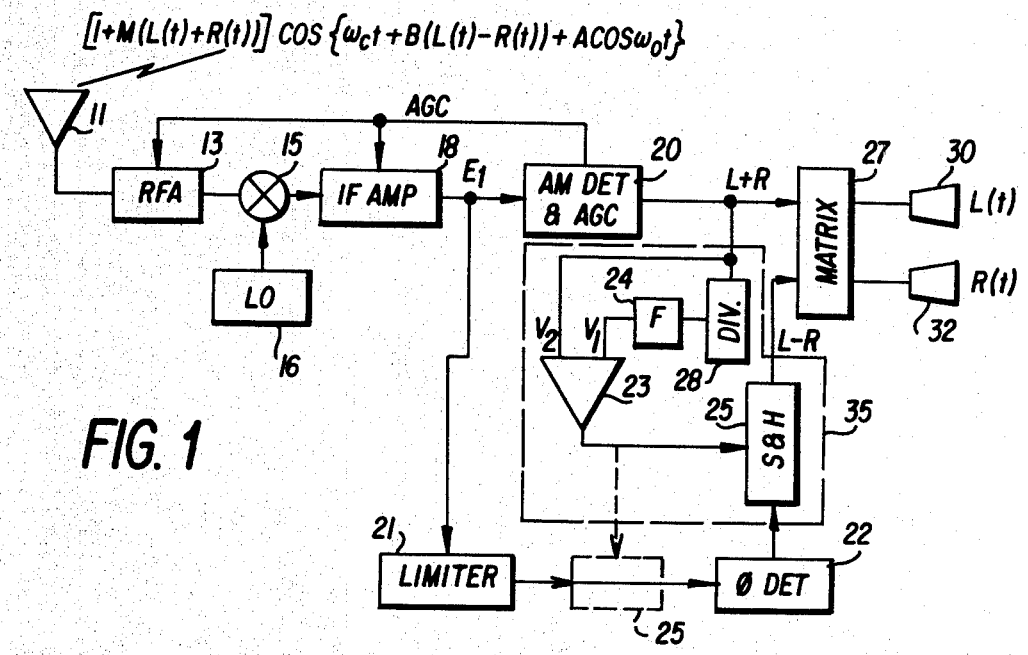
FIG. 1 is a block diagram of a receiver for demodulating a broadcast signal having amplitude and angle modulation.

Referring now to FIG. 1, there is shown a superheterodyne receiver for demodulating a broadcast signal modulated in amplitude and angle by stereophonic related signals. Specifically, a broadcast signal of the type proposed by the Magnavox Consumer Electronics Company, FCC Docket 21313, "In The Matter of AM Stereophonic Broadcasting" is described by the equation appearing in FIG. 1. First and second stereophonically related signals, L(t) and R(t) are additively combined to produce a summation signal which amplitude modulates a broadcast signal having a carrier frequency of $W_c$. Further, the carrier frequency signal is linearly phased modulated with a difference signal comprising the subtractive combination of the stereophonically related signals. The signal is further frequency modulated with a low frequency identifying signal having a sinusoidal frequency of $W_o$ which is preferably 5 Hz.

The composite broadcast signal is received by antenna 11 and applied to radio frequency amplifier 13. RF amplifier 13, mixer 15, and local oscillator 16 form known conversion means of the superheterodyne type which provide an intermediate frequency signal to intermediate frequency amplifier 18. The intermediate frequency signal is amplified therein and applied to an AM detector-AGC circuit 20 as well as limiter 21. AM detector-AGC circuit 20 provides both an AGC voltage to control the gain of amplifiers 13 and 18, as well as an amplitude demodulated signal representing the summation of the stereophonic related signals, hereinafter L+R signals. The L+R signal is applied to a matrix means 27 to be combined with a difference signal, hereinafter L−R signal, which is derived as follows.

Limiter 21 removes much of the amplitude modulation appearing on the intermediate frequency signal to condition the signal for angle detection. Phase detector 22 will provide an output signal which is the linear function of the phase change of the signal supplied by limiter 21. In practice, the inventors have found that a frequency discriminator with a deemphasis network can satisfactorily work as a phase detector 22. The deemphasis network comprises a low pass filter having a 3 DB point below the frequency of interest, which has been in the neighborhood of 20–30 hz.

The output of the deemphasis network is a substantially phase detected signal which represents the aforementioned difference signal used to linearly phase modulate the broadcast signal carrier to a modulation index of B. The difference signal L−R can be matrixed through a matrix 27 to provide stereophonic related signals L and R. Matrix 27 supplies stereophonic related signals to speakers 30 and 32 where they become audible.

The superheterodyne receiver of FIG. 1 is equipped with a circuit 35 for minimizing the affects of a loss of carrier frequency signal during angle demodulation. Circuit 35 operates to temporarily disable the output from phase detector 22 and hold a sampled value of L−R signal for matrix 27 during the period that limiter 21 has dropped out of limiting due to a loss in signal, or is receiving a marginally low amplitude signal. The circuit shown in 35 detects when the negative modulation on the broadcast signal is below a level which will maintain limiter 21 in limiting condition. When the negative modulation of the broadcast signal reaches a predetermined value, which is preferably 95%, sample and hold circuit 25 holds the output signal received from phase detector 22 until the negative modulation is less than 95% at which time sample and hold circuit 25 delivers the output of phase detector 22 to matrix 27.

FIG. 1 indicates that the sample and hold circuit is placed between an input of matrix 27 and the output of phase detector 22. Alternatively, the sample and hold circuit 25' may be placed between the limiter and phase detector 22.

The detection of a marginal amplitude broadcast signal is provide by a comparator 23 having a reference input $V_1$ and a signal input $V_2$. The detected output from AM detector-AGC circuit 20 representing the instantaneous amplitude of the broadcast signal is applied to input $V_2$ of comparator 23. A reference voltage $V_1$ has a magnitude and polarity which represents the condition of interest, namely 95% negative amplitude modulation. The reference voltage is derived through a divider 28 and low pass filter 24. Low pass filter 24 maintains a relatively constant voltage at input $V_1$, the magnitude of the input voltage being determined by the output of voltage divider 28. Thus, by selecting the proper divisor for the voltage divider 28, it is possible to establish a voltage $V_1$ which is relatively constant and has a magnitude approximately equal to the detected voltage produced by an amplitude modulated broadcast signal having 95% negative modulation.

Thus, when the summation signal L+R applied to input $V_2$ is substantially equivalent to the reference voltage $V_1$, comparator 23 will place sample and hold circuit 25 into a hold condition. As the modulation depth on the broadcast signal continues to increase, sample and hold circuit 25 will be maintained in a hold condition wherein the L−R signal detected at approximately the −95% amplitude modulation peak is maintained at the input of matrix 27. Once the negative amplitude modulation returns to a condition of less than −95% modulation, sample and hold circuit 25 will be returned to the sample condition and the L−R signal from phase detector 22 will be applied to an input of matrix 27. An alternative to supplying a varying voltage level from AM detector 20 to input $V_1$ is to supply a fixed dc voltage which does not vary with signal level. This will result in a hold condition being effected under weak signal conditions at a lower amplitude modulation depth than for higher level signals. This alternative results in a dynamic hold circuit which provides for adaptive noise silencing under different input signal conditions.

Figure 2:
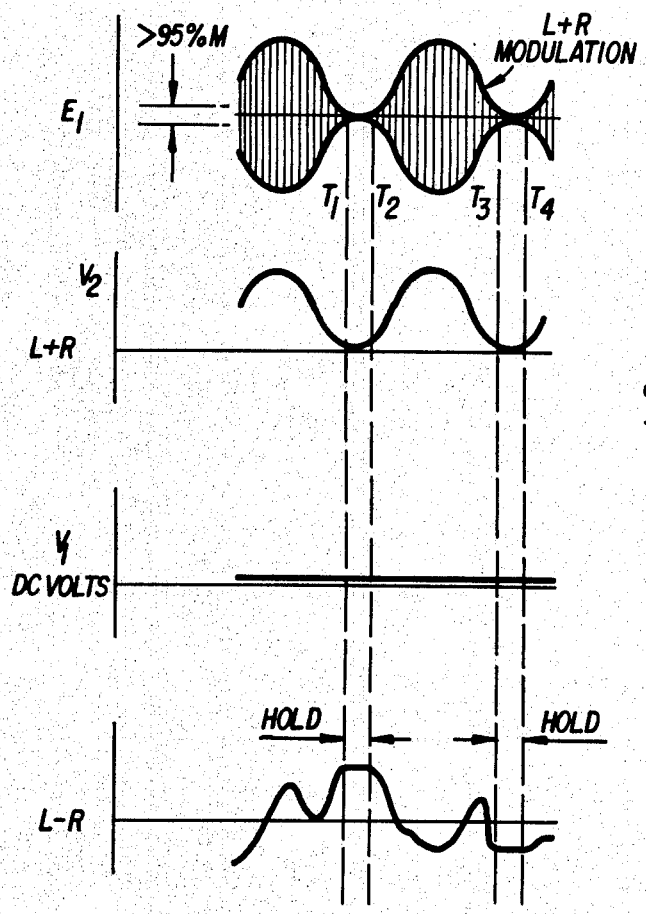
FIG. 2 illustrates the signal wave forms appearing in the receiver of FIG. 1.

The operation of circuit 35 of FIG. 1 can be further understood by reference to FIG. 2. $E_i$ represents the intermediate frequency signal provided by intermediate frequency amplifier 18. During times $T_1$–$T_2$ and $T_3$–$T_4$, the negative modulation peaks exceed 95%. Those skilled in the art will reconize that the intermediate frequency signal amplitude variations correspond substantially to the amplitude variations of the received broadcast signal and are in other respects proportional thereto.

The input signal $V_2$ to the comparator 23 is shown also in FIG. 2. This signal corresponds to the L+R AM detected audio signal. On input $V_1$, there is shown a derived reference voltage which is substantially the level of DC voltage which appears on input $V_2$ at the time a 95% negative modulation condition is being amplitude detected. This DC component $V_1$ when equal to or greater than the input voltage $V_2$ forces the output of comparator 23 into a change of state and sample and hold circuit 25 enters a hold condition. The L−R audio signal supplied by sample and hold circuit 25 is held at a voltage corresponding to the output of phase detector 22 at the time 95% negative amplitude modulation occurred. As FIG. 2 illustrates, at time $T_2$ when the negative amplitude modulation is less than 95%, sample and hold circuit 25 returns to a sample mode whereby the changing signal output of phase detector 22 is once again applied to the matrix 27.

Figure 3:
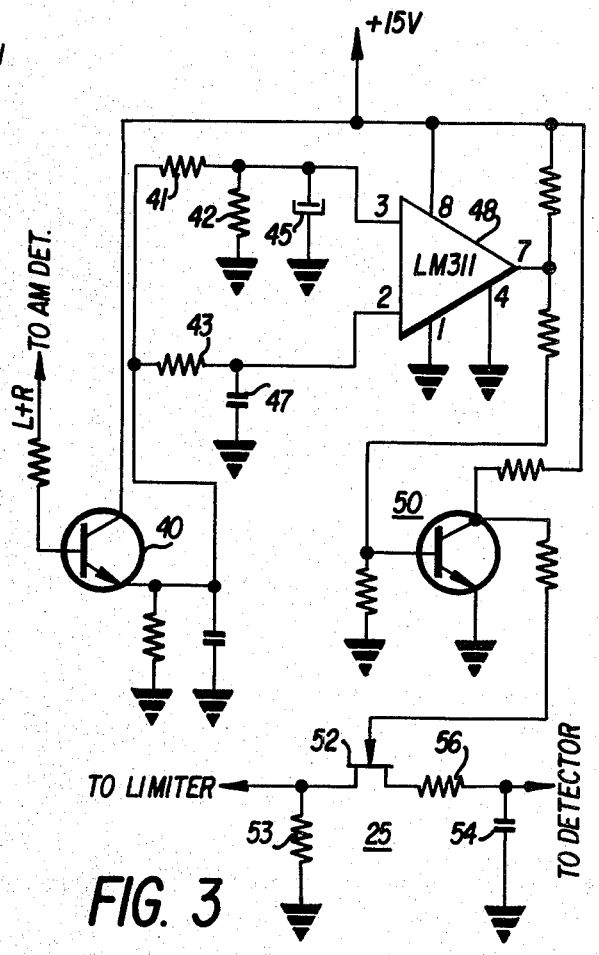
FIG. 3 is a schematic drawing of specific circuitry for implementing circuit 35 of FIG. 1.

Referring now to FIG. 3, there is shown specific circuitry for implementing circuit 35 of FIG. 1. An emitter follower circuit 40 has an input connected through resistor 39 directly to the AM detector-AGC circuit 20. The output of emitter follower 40 is applied to input 2 of a differential comparator 48 through a resistor 43. The output of the emitter follower 40 is also applied to a second input 3 of differential comparator 48 through a resistor 41. Resistors 41 and 42 comprise a voltage divider which selects the level of the reference voltage applied to input 3. In the preferred embodiment of the invention, resistor 41 was selected to be 10,000 ohms and resistor 42 was selected to be 470 ohms. The voltage thus divided corresponded to a substantially 95% negative amplitude modulation condition. A capacitor 45 which was selected to be 100 ufd terminates resistor 42 such that the voltage held at input 3 is substantially constant.

Thus, by selecting a proper ratio between resistor 41 and 42 it was possible to establish a fixed voltage at input 3 of differential comparator 48 corresponding to the amplitude modulation condition of interest.

The output of differential comparator 48 as applied to driver transistor 50 which has an output for selectively biasing a P-channel FET into conduction.

The sample and hold circuit comprises a P-channel FET 52 having a source connected to resistor 53 which in turn is connected to a common ground connection. The drain connection of P-channel FET 52 supplies the output signal. Shown in FIG. 3 is a resistor 56 which will provide the aforementioned deemphasis condition along with capacitor 54 when the sample and hold circuit is placed between the limiter 21 and detector 22. As was noted previously, a deemphasis network in conjunction with a frequency discriminator will provide the desired phase demodulation output, assuming that the deemphasis frequency is selected to be lower than the lowest audio frequency of interest. If a frequency discriminator is not used to angle demodulate the output signal of limiter 21, then resistor 56 may be dispensed with and capacitor 54 will merely serve as a holding capacitor.

The circuit of FIG. 3 contemplates placing the sample and hold circuit 25' between the limiter 21 and phase detector 22 particularly when a deemphasis resistor 56 and a frequency discriminator are used as a phase detector. It has been found that this technique results in maintaining the input to the deemphasis resistor 56 constant during a hold condition, which in turn holds the discriminator output and matrix 27 input at a constant level. When the deemphasis resistor 56 is not present, the sample and hold circuit may be placed between the phase detector 22 output and the matrix 27 input as is shown in FIG. 1.

Thus, there has been described with respect to FIG. 3 specific circuitry for detecting when the peak negative amplitude modulation of a received broadcast signal is below a predetermined minimum, as well as providing a hold circuit for maintaining an audio difference signal at a fixed level during the reception of undesirably low level amplitude modulation signals.

Thus, with the circuitry as described, it is possible to avoid conditions whereby the phase detector 22 is receiving little or no signal from limiter 21 which can produce objectionable noise in a detected output signal from phase dectector 22. With the circuit thus described, phase detector 22 does not produce sharp transients or other undesirable affects when the amplitude modulation approaches a condition whereby a zero level broadcast signal is being demodulated in phase or frequency.

Although the foregoing embodiments have been described in terms of a broadcast receiver for demodulating a linearly phase modulated broadcast carrier, those skilled in the art will recognize that the techniques disclosed are suitable for use with other angle modulation systems which may also employ amplitude modulation.

We claim:

1. In a receiver for processing a stereophonic broadcast signal, said signal having amplitude modulation components representing the summation of stereophonic related signals, and angular modulation components representing the difference of stereophonic related signals comprising:

conversion means for converting said broadcast signal to an intermediate frequency signal;

amplification means for amplifying said intermediate frequency signal;

an amplitude detector for providing a demodulated signal proportional to said summation of stereophonic related signals;

a limiter connected to receive said intermediate frequency signal;

an angle demodulator connected to receive a signal from said limiter for producing a demodulated signal proportional to said difference of stereophonic related signals;

a sample and hold means for continuously passing a signal from said angle demodulator in the absence of a hold signal;

matrix means for combining a signal from said sample and hold means with a signal from said amplitude detector whereby stereophonic related signals are produced; and means for detecting excessive negative amplitude modulation on said intermediate frequency signal, said means providing a hold signal to said sample and hold means wherein the output signal from said sample and hold circuit is maintained substantially constant during excessive negative amplitude modulation.

2. A circuit for processing an intermediate frequency signal in a superhetereodyne receiver, said signal having amplitude modulations proportional to the summation of two stereophonic related signals and angularly modulated with the difference of said two stereophonic related signals comprising:

an amplitude detector for providing a demodulated summation signal in response to said intermediate frequency signal;

an angle demodulator for providing a demodulated difference signal in response to said intermediate frequency signal;

a sample and hold circuit connected to continuously supply said demodulated difference signal in the absence of a hold signal;

means for combining an output signal from said sample and hold circuit with a signal from said amplitude detector whereby first and second stereophonic related signals are produced; and means for detecting excessive negative amplitude modulation peaks which exceed a predetermined level on said intermediate frequency signal, said means providing a hold signal to said sample and hold circuit wherein the output signal from said sample and hold circuit is maintained substantially constant during excessive negative amplitude modulation.

3. The circuit of claim 2 wherein said means for detecting negative amplitude modulation peaks comprises:

a differential comparator circuit having first and second comparing inputs, said first input being connected to said amplitude detector;

a voltage divider connected from said amplitude detector to said second input, said voltage divider being terminated in a capacitor whereby a dc voltage is established at said second input representing a peak modulation limit; and said differential comparator being switched in response to a modulation signal voltage on said first input which exceeds the voltage on said second input.

4. The circuit of claim 2 or 3 wherein said sample and hold circuit comprises:

a field effect transistor having a gate, source and drain, said gate being operatively coupled to said means for detecting;

a source resistor having one end connected to said source and a remaining end connected to a common terminal;

a capacitor operatively coupled between said drain and said common terminal; and said source and common terminal being connected to receive a signal from said angle demodulator, said drain and common terminal delivering a signal to said matrix means.

5. A circuit for demodulating a signal having both amplitude and angle modulation components comprising:

an amplitude demodulation means for providing a signal proportional to the instantaneous amplitude of said signal;

an angle demodulator for providing an output signal proportional to said angle modulation components;

means for sampling and holding said angle demodulator output signal; and threshold detector means connected to said means for sampling and said amplitude demodulator means, said threshold detector means providing a hold signal to said means for sampling and holding during periods when said modulated signal has an amplitude below a predetermined minimum level.

6. A circuit for demodulating a signal having both amplitude and angle modulation components comprising:

an amplitude demodulation means for providing a signal proportional to the instantaneous amplitude of said signal;

an angle demodulator for providing a signal proportional to said angle demodulation components;

threshold detection means connected to said amplitude demodulation means, said threshold detection means providing a control signal when the signal from said amplitude demodulation means is below a reference level; and means for supplying a fixed voltage to said angle demodulator in response to said control signal whereby said angle demodulator provides a fixed output voltage when the amplitude of the modulated signal is below a predetermined level.

7. A circuit for processing an intermediate frequency, said signal having amplitude modulations proportional to the summation of two stereophonic related signals and angle modulation proportional to the difference of said two stereophonic related signals comprising:

an amplitude detector for providing a demodulated summation signal in response to said intermediate frequency signal;

a limiter for receiving said intermediate frequency signal;

a sample and hold circuit having an input connected to said limiter for receiving an amplitude limited signal; and an output for delivering said limited signal in the absence of a hold signal;

an angle demodulator for providing a demodulated difference signal from an amplitude limited signal received from said sample and hold circuit;

means for combining an output signal from said angle demodulator with a signal from said amplitude detector whereby first and second stereophonic related signals are produced; and means for detecting negative amplitude modulation peaks of said intermediate frequency signal which exceed a predetermined level, said means providing a hold signal to said sample and hold means during high negative amplitude modulation peaks whereby a fixed voltage is maintained to said angle demodulator.

8. A circuit for processing an intermediate frequency signal, said signal having an amplitude modulation proportional to the summation of two stereophonic related signals and an angle modulation proportional to the difference of said two stereophonic related signals comprising:

an amplitude detector for providing a demodulated summation signal from said intermediate frequency signal;

an angle demodulator for providing a demodulated difference signal from said intermediate frequency signal;

a matrix means having first and second inputs for receiving said summation and difference signals respectively;

threshold detection means for providing a hold signal when the amplitude of said intermediate frequency signal is below a predetermined level; and means for interrupting a signal from said angle demodulator and maintaining a fixed voltage on said second input in response to a signal from said threshold detection means.

9. The circuit of claim 8 wherein the fixed voltage applied to said second input is substantially equal to the instantaneous output voltage from said angle demodulator at the time a signal is produced by said threshold detection means.

10. The circuit of claims 8 or 9 wherein said threshold detection means comprises:

a differential comparator circuit having first and second comparing inputs, said first input being connected to receive a signal from said amplitude detector; and means for providing a reference voltage to said second input, said differential comparator being switched when the voltage difference between inputs is a predetermined amount.

* * * * *

UNITED STATES PATENT AND TRADEMARK OFFICE

CERTIFICATE OF CORRECTION

PATENT NO. : 4340782

DATED : July 20, 1982

INVENTOR(S) : James R. Weigand: Robert D. Streeter

It is certified that error appears in the above—identified patent and that said Letters Patent is hereby corrected as shown below:

Column 5

Line 8, delete "between the limiter 21 and" and insert -- after the --.

Line 20, delete "a" and resistor 56".

Line 23, delete "input to the deemphasis resistor 56" and insert -- discriminator output signal --.

Line 26, delete "not".

Signed and Sealed this

Nineteenth Day of October 1982

[SEAL]

Attest:

GERALD J. MOSSINGHOFF

Attesting Officer

Commissioner of Patents and Trademarks